US005729954A

United States Patent [19]

Lines et al.

[11] Patent Number: 5,729,954

[45] Date of Patent: Mar. 24, 1998

[54] ENVELOPE FLAP OPENER APPARATUS

[75] Inventors: George G. Lines, Sacramento; James W. Hart, El Dorado Hills; Jonathan D. Emigh, Somerset, all of Calif.

[73] Assignee: International Billing Services, Rancho Cordova, Calif.

[21] Appl. No.: 706,273

[22] Filed: Sep. 4, 1996

(Under 37 CFR 1.47)

[51] Int. Cl.[6] ..... B65B 43/26

[52] U.S. Cl. ..... 53/381.7; 53/381.5; 53/382.1; 53/381.1; 53/69; 53/468; 493/450; 493/256; 493/12

[58] Field of Search ..... 53/381.1, 381.5, 53/381.7, 55, 385.1, 382.1, 569, 69, 468, 67, 75, 492; 493/212, 309, 255, 258, 259, 450, 256, 12, 453

[56] References Cited

U.S. PATENT DOCUMENTS

| | | | |
|---|---|---|---|
| 2,376,289 | 5/1945 | Stenglein | 53/381.7 |
| 2,569,219 | 9/1951 | Bamber et al. | 53/569 |
| 3,815,319 | 6/1974 | Vedvik | 53/382.1 |
| 3,858,381 | 1/1975 | Huber et al. | 53/385.1 |
| 4,296,068 | 10/1981 | Hoshino | 53/167 |
| 4,551,188 | 11/1985 | Schulze | 53/381.7 |
| 4,781,013 | 11/1988 | DePasquale et al. | 53/381.7 |
| 4,811,547 | 3/1989 | Raats et al. | 53/382.1 |
| 4,994,129 | 2/1991 | Nakagaki | 53/485 |
| 5,282,350 | 2/1994 | Crowley | 53/55 |
| 5,327,705 | 7/1994 | DeFigueiredo | 53/381.7 |
| 5,511,357 | 4/1996 | Ricketts et al. | 53/55 |

*Primary Examiner*—James F. Coan
*Assistant Examiner*—Gene L. Kim
*Attorney, Agent, or Firm*—James M. Ritchey

[57] ABSTRACT

A flap opening apparatus wherein envelopes are sequentially conveyed past a jet nozzle, which delivers timed blasts of air to open the flaps of each envelope. A computer controller tracks the position of the envelopes by a shaft encoder, and activates the jet nozzle when each envelope is correctly positioned. The opened flaps of the envelopes are held in an open position by a plate so that mail materials may be inserted into the envelopes.

9 Claims, 5 Drawing Sheets

ENVELOPE FLAP OPENER APPARATUS

BACKGROUND OF THE INVENTION

1. Field of the Invention

The subject invention pertains generally to devices and methods for opening envelope flaps. More particularly, a dynamically controlled envelope flap opener is disclosed wherein an air jet is used to open flaps of unsealed envelopes prior to the insertion of mail materials into the envelopes.

2. Description of the Background Art

Large scale, high volume mailing operations, such as the issuance of periodic billing statements or mass advertising, are generally carried out by high speed mail processing and mail assembly systems which facilitate several mail preparation steps. Operations carried out by such mail processing systems typically include the printing, organizing, collating, and folding of mail materials, insertion of the mail materials into envelopes, envelope sealing, postage metering, and other operations.

For envelope insertion operations, it is generally necessary to provide a stream of envelopes which have had the envelope flap opened or otherwise positioned so mail materials may be inserted therein. In the background art mail processing systems, envelopes are mechanically removed from a stack of envelopes, and placed onto a track, belt, or other conveyance system that brings the envelopes past an opening blade which is structured, configured, and positioned to lift up the envelope flaps to an open position so that the insertion step can be carried out. Envelopes can only be conveyed past an opening blade below a certain threshold speed. At higher speeds, the blade, upon coming into contact with the flap and envelope, will tear or otherwise damage the flap and envelope, resulting in a damaged or defective mail piece or resulting in jamming of the equipment associated with the downstream envelope insertion or sealing operations, causing system shutdown and delay. To overcome this problem, the use of moving brushes, air jets, and suction or vacuum means have been employed to facilitate envelope flap opening at higher speeds.

The advent of computer controlled mail processing operations has resulted in development of mail preparation systems which can operate generally at high speeds, but are limited in speed by certain steps, such as the opening of envelope flaps. Air jets have been previously utilized for envelope flap opening by placing an air nozzle adjacent to a stream of envelopes and positioning the nozzle to push open the envelope flaps as the envelopes pass the nozzle. However, previous envelope flap opening devices and methods have proved deficient in various respects. Particularly, the use of a continuous air jet directed towards passing envelopes on a conveyor system to open the envelope flaps tends to result in unnecessary drain on the compressed air source and creates air currents can interfere with other nearby mail processing operations. The use of timed or pulsed air blasts may be used to remedy these problems, but delivery of correctly timed air pulses for envelope flap opening in high speed mail processing operations has heretofore not been effectively carried out.

Accordingly, there is a need for an envelope flap opener apparatus which quickly and efficiently opens envelope flaps for insertion of materials thereinto, which avoids tearing or damaging envelopes, which operates at high speeds suitable for use in high speed mail processing systems directed by integrated computer control, and which delivers timed air blasts to open envelope flaps according to computer control. The present invention satisfies these needs, as well as others, and overcomes the deficiencies found in the background art.

SUMMARY OF THE INVENTION

An object of the invention is to provide an envelope flap opener apparatus which employs an air jet in the opening of an envelope flap by delivering timed pulses or blasts of compressed air to envelope flaps.

Another object of the invention is to provide an envelope flap opener apparatus which may be operated under integrated computer control for high speed envelope flap opening.

Yet another object of the invention is to provide an envelope flap opener apparatus which delivers timed, intermittent air blasts according to instructions from a controlling computer.

Still another object of the invention is to provide an envelope flap opener apparatus which avoids tearing or damaging envelopes during flap opening.

Further objects of the invention will be brought out in the following portions of the specification, wherein the detailed description is provided for the purpose of fully disclosing the invention without placing limits thereon.

Disclosed is an envelope flap opener apparatus which utilizes a pressurized air jet for opening envelopes. The subject invention is generally employed in mail processing systems for use with conventional mailing envelopes having a flap, a body, and a fold region connecting the flap to the body of the envelope. Thus, the terms "envelope" and "flap" as used herein should be understood as referring to the aforementioned conventional type of mail envelope.

In general terms, the invention comprises jet means for providing pulses or blasts of pressurized air, control means for directing activation of the jet means, and means for conveying envelopes past the jet means. The subject invention also preferably comprises input or supply means for sequentially providing a plurality of envelopes to the conveying means, retention means for holding an envelope flap in the opened position, encoder means, interfaced with the control means, for tracking the position of envelopes in the conveying means, and sensor means, interfaced with the control means, for detecting whether an envelope flap has been properly opened by the jet means.

By way of example and not of limitation, the jet means is preferably a gas nozzle coupled to a compressed gas supply line and source, with a solenoid control valve included in the supply line. The jet means preferably uses compressed air, and is generally used in association with a conventional inserter apparatus and/or mail processing system. The conveying means is preferably a belt, chain, or track associated with the inserter apparatus and positioned adjacent to the jet means, with the conveying means having a plurality of means for holding envelopes. The input means preferably comprises a conventional envelope transferring system wherein envelopes are sequentially removed from a stack of envelopes and pushed or transferred onto the conveying means. The retention means preferably comprises a metal strip or plate which defines a lower region wherein an opened envelope flap is held. The control means preferably comprises a control computer or like programmed data processor which is integrated with the mail processing system and inserter apparatus, and which is interfaced with the solenoid control valve that allows air supply from the compressed air source to reach the nozzle of the jet means. The encoder means is preferably a conventional shaft encoder located on a drive shaft or a timing shaft of the inserter apparatus, or within an electric motor, and which is interfaced with the control means. The sensor means is preferably a photocell type sensor or sensors, or equivalent device, associated with the retention means, which monitors the envelopes and detects if an envelope flap has not been properly opened by the jet means.

In operation of the subject invention, envelopes from the input means are sequentially provided to the conveying means which conveys the envelopes past the nozzle of the jet means. As each envelope passes the jet means, the controlling computer actuates the control valve on the gas line, providing compressed air or other gas to the jet means. The nozzle then provides a blast of compressed air which is directed towards the flap of each envelope as it passes by the nozzle along the conveyor means. The conveying means and input means preferably are mechanically interfaced with and driven by an inserter drive shaft. The encoder means is included on the inserter drive shaft, or on a timing shaft associated with the drive shaft, or included within an electric motor which drives the drive shaft. The encoder means informs the control computer, based on detected shaft or motor rotational angles, of the location of the envelopes in the conveying means so that the control computer can actuate the control valve at the appropriate time when each envelope is adjacent to the jet means to provide a correctly timed pulse or blast of compressed air. The opened flap of each envelope is held down by the retention means so that mail materials may be inserted therein. If the sensor means associated with the retention means detects that an envelope flap has not been properly opened, the control computer is thus informed and shuts down the mail processing system to allow an operator to correct the improperly opened envelope, thereby preventing downstream processing errors.

BRIEF DESCRIPTION OF THE DRAWINGS

The invention will be more fully understood with reference to the following drawings, which are for illustrative purposes.

DESCRIPTION OF THE PREFERRED EMBODIMENT

Figure 1:
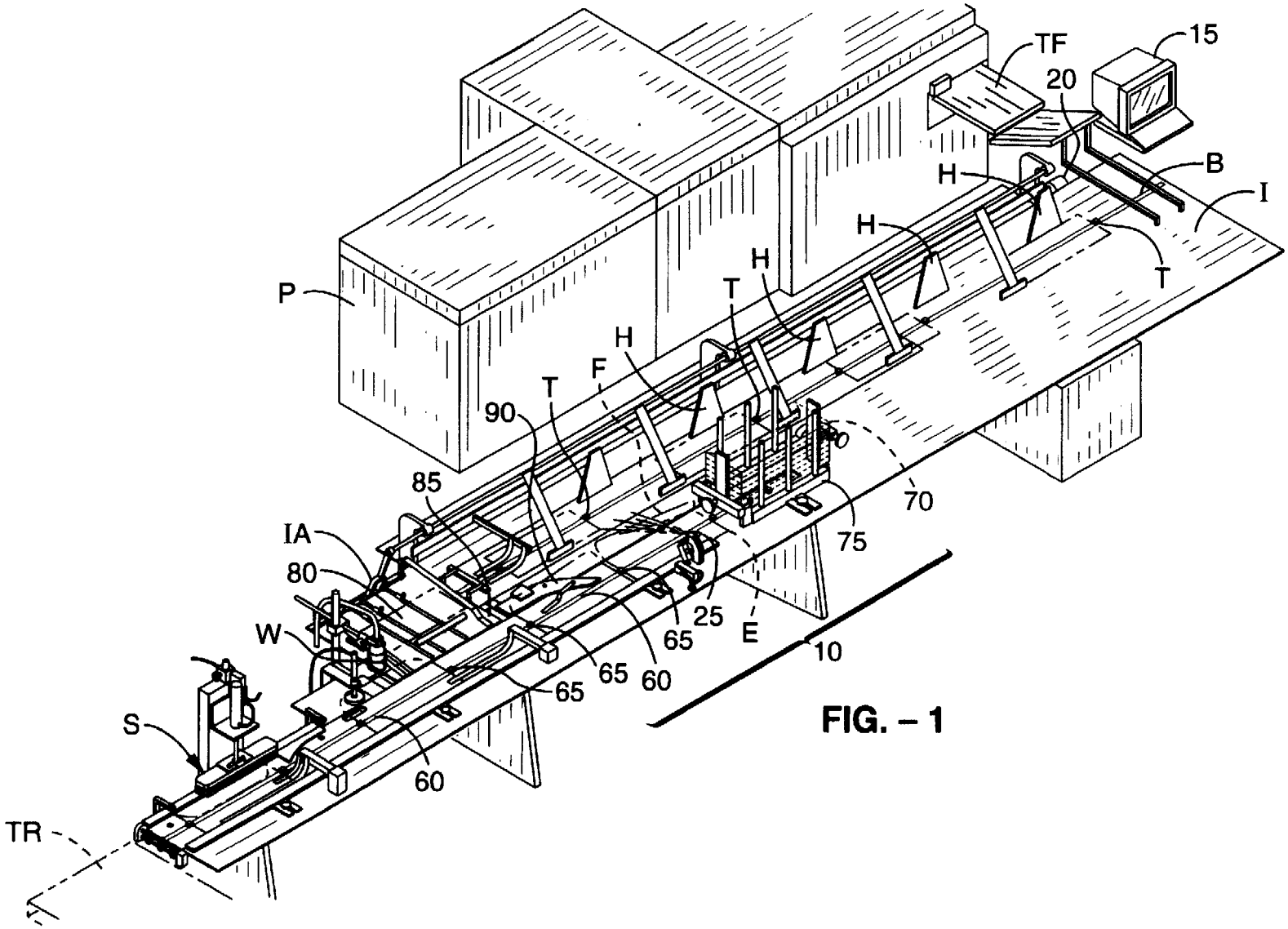
FIG. 1 is a perspective view of an envelope flap opener apparatus in accordance with the subject invention shown in association with a conventional inserter apparatus.
Figure 2:
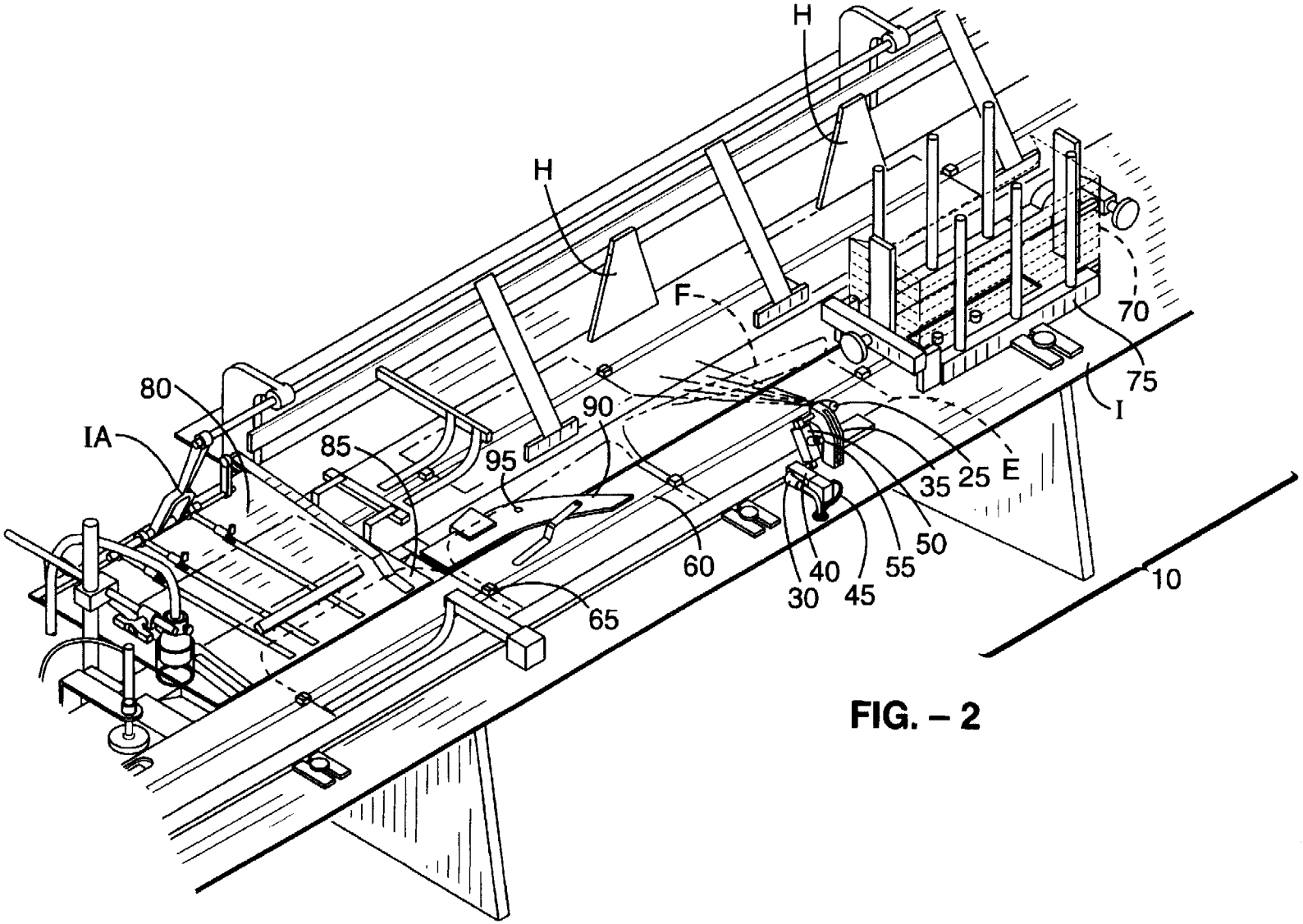
FIG. 2 is a perspective view in detail of the envelope flap opener apparatus shown in FIG. 1.
Figure 3:
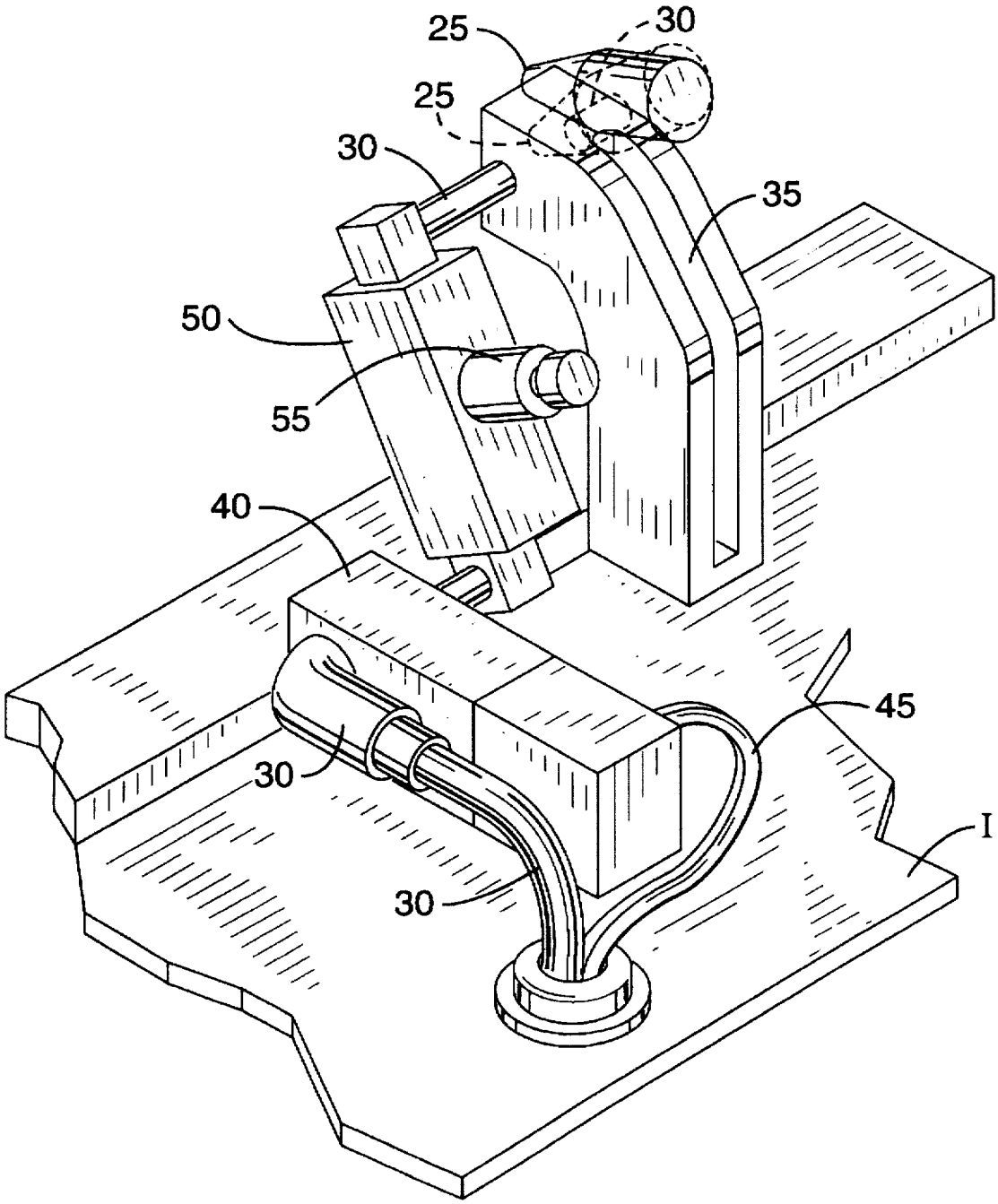
FIG. 3 is a perspective view of the jet means of the subject invention.

Referring now to FIGS. 1–3, there is shown a preferred embodiment of an envelop flap opening apparatus 10 in accordance with the subject invention. Generally, the subject apparatus is utilized in connection with an envelope assembly system (FIG. 1) that assembles mailing pieces for bulk mailing operations. An assembled mailing piece generally comprises an outer mailing envelope E, internal forms or folded pages (such as detailed and summary billing statements), inserts (such as advertisements, notices, and the like), a return envelope, and similar items. Each mailing envelope is of a traditional or standard configuration having a flap with an area for adhesive, a body, and a fold region connecting the flap to the body. Usually, the envelope or mailing piece assembly system comprises a forms or pages source such as a printer P, means for folding or a transport assembly TF for transferring the forms or pages to subsequent equipment, a traditional envelope inserter machine I that places various hopper H held inserts into a mailing envelope E, and inserter arm IA for placing mail materials into envelopes, a wetting apparatus W for wetting adhesive on envelope flaps, a sealing apparatus S for sealing the envelope flaps after wetting, and a transport TR apparatus for subsequent processing of the stuffed and sealed envelopes (in particular, see FIG. 1). The subject envelope flap opener apparatus is generally associated with or mounted on the inserter I at a position which is upstream or prior to inserter arm IA, so that a stream of opened envelopes are directed past inserter arm IA for insertion of mail materials thereinto.

Usually, a typical mailing piece comprising a bill from a product or service provider is assembled as follows: 1) detailed and summary statement sheets are printed and collated in the high speed printer P; 2) the statement sheets are folded and transferred by suitable means TF to the inserter machine I; 3) mailing envelopes E have their flaps opened by the opener apparatus comprising the present invention, as discussed below in detail; 4) single or multiple inserts are supplied via the various hoppers H and associated mechanisms and delivered by a chain or belt B system with tines T to the actual insertion means or insertion arms IA; 5) each stuffed envelope is moved to the wetting apparatus W and sealing apparatus S wherein the envelopes are wetted and sealed, and 6) the assembled mailing piece is placed in a transport TR apparatus for subsequent processing. It must be noted that even though the above scheme is a common assembly pathway, more complex assembly pathways, as well as simpler pathways, are contemplated for use in conjunction with the present invention. Thus, the aforementioned mail processing scheme is merely for exemplary purposes.

More specifically, the subject invention comprises an envelope flap opener apparatus 10 having a control means which oversees the assembly operation. Although the controller means may be any now known or later developed hardwired or equivalent means, preferably, the control means is a computer 15 or other programmed data processor which is programmed to monitor and direct the assembly of each mailing piece according to appropriate data base and equivalent information. The computer 15 is normally used by an operator and may be a stand alone unit or linked directly or indirectly to additional hardware and software, or the equivalent, having additional information and controlling routines. The computer 15 monitors and directs, usually in cooperation with the operator, the various phases of the assembly process, including operation of the subject apparatus 10.

Since the computer 15 oversees the aforementioned assembly process, the location of each item comprising the mailing piece is carefully tracked. The computer is configured and equipped with appropriate input devices to detect various errors such as mismatched forms, inserts, envelopes, and the like. Such error detection devices may include readers (bar code readers and the like) that scan for indicia encoded forms, envelopes, inserts, and the like to verify that correct items are within each mailing piece. When errors are encountered by the computer the assembly process can be halted or allowed to proceed, depending upon an operator's election or standard protocol. Typically, should a faulty mailing piece be detected the computer 15 has the option of stopping the process.

Computer 15 establishes the locations for envelopes E and the other various items to go within the envelopes E by tracking encoded indicia or monitoring position with photocells at known positions in the inserter I, the subject apparatus 10, and at the wetting and sealing apparatus W, S. The position of envelopes E and other items is also generally monitored by utilizing the machine cycle of the typical inserter I. A typical inserter I includes a central rotating timing shaft and drive shaft that operates the insert hoppers H, insertion means IA, drive chain C, and the like. A standard shaft encoder 20 is coupled to the inserter's central timing shaft and interfaced with computer 15, and is utilized to fix the position of any item on the inserter I. Combining the established locations for the error detection scanners and photocells with the information derived from the shaft encoder allows the computer to know when each envelope E is positioned to be opened by the subject opener apparatus.

Referring more particularly to FIG. 2 and FIG. 3 as well as FIG. 1, the presently preferred embodiment of the subject envelope flap opener apparatus 10 is shown in detail. Included in the apparatus 10 are jet means for providing or directing pressurized gas to envelope flaps F, preferably comprising gas nozzle 25 which is coupled to gas supply line 30. Nozzle 25 and supply line 30 are preferably mounted on inserter I by supporting base 35. Base 35 may include translational means (not shown) for positionally adjusting nozzle 25, if desired. Base 35 is generally mounted directly onto inserter apparatus I as shown, but may be mounted on other equipment surfaces, depending upon the envelope opening operation to be carried out. Preferably pivot means for adjustably positioning nozzle 25 is included with the jet means, as shown by dashed lines in FIG. 3. The pivot means may be any conventional mounting which allows adjustable pivotal motion. Additional nozzles (not shown) may also be employed with the jet means of the invention. However, a single nozzle 25 has been found to be effective in the opening of flaps on conventional envelopes, and thus inclusion of a single nozzle 25 with the jet means is presently preferred.

The pressurized gas used with the jet means of the invention is preferably compressed air, which is directed to nozzle 25 via supply line 30 from a compressed air source (not shown) such as an air compressor or pressure tank. Other gasses or gas mixes may also be used with the jet means of the invention, although air is preferred.

Valve means for controlling air or gas supply to nozzle 25 are preferably included with the jet means, and preferably comprise control valve 40, which is generally a solenoid or air actuated valve which, when open, allows compressed air to reach nozzle 25. Control valve 40 is mounted on supply line 30, and is interfaced with computer 15 via wire 45 or other standard electronic interface, so that computer 15 may actuate valve 40, to provide compressed air to nozzle 25 in correctly timed intermittent blasts when an envelope E is positioned adjacent to nozzle 25, as discussed further below. It is also contemplated that the jet means may provide a continuous, uninterrupted air supply and provide a continuous blast of compressed air towards the conveying means, so that each envelope flap F is opened as it passes the air blast from nozzle 25. Such an arrangement is generally is not preferred, as it would cause an unnecessary drain on the compressed air supply used with the invention, thereby incurring unnecessary expense and possibly interfering with other mail assembly steps which may require compressed air from the same source.

The jet means of the invention may also include a needle valve 50, which is hand actuated by rotating knob 55. Needle valve is used to regulate generally the amount or volume of air or gas directed to nozzle 25, while control valve 40 regulates the timing of air blasts from nozzle, at the direction of computer 15. Needle valve 50 may be adjusted in situations, for example, where envelopes E having flaps F of different sizes, shapes, and weights are employed, wherein a greater or smaller amount of compressed air is necessary to correctly open the envelope flaps F.

As aforementioned, the subject invention includes means for conveying, transporting, or generally moving a plurality of envelopes E past the jet means in a sequential fashion, so that the timed blasts of compressed air from nozzle 25 can open the flaps F on each envelope E. The conveyor means preferably comprises a conventional track, chain or belt 60 which includes a plurality of envelope holding means such as claws 65, or alternatively, clamps, clasps, tines, or like means which hold envelopes E onto belt 60. Belt 60 is preferably mechanically interfaced with and driven by the drive shaft (not shown) of the inserter apparatus I, although belt 60 may be mechanically driven by another source.

Input means for supplying or providing envelopes to the conveyor means are also preferably included with the subject invention. Preferably, the input means comprises a standard envelope input system having a stack 70 of envelopes held in a rack 75 located adjacent the upstream end of belt 60. The envelope input system generally employs vacuum means (not shown) beneath stack 70, which are mechanically interfaced with the inserter I drive shaft, to sequentially draw envelopes down from the bottom of stack 70 and release them, so that a kicker (not shown) can push each envelope into a claw 65 or other holding means on belt 60. Other envelope input means, such as the sequential delivery of envelopes to belt 60 via a chute (not shown), with compressed air and/or vacuum assistance, may also be utilized with the invention.

The fold region of typical paper envelopes generally exhibit a slight resilience, so that an envelope flap F, when quickly opened as in the present invention, tends to rebound or recoil back towards its original closed position. Accordingly, retention means, for holding the opened envelope flaps F in an open position, are preferably provided with the invention. Generally, the retention means comprises a plate 80 or like structure positioned adjacent to the conveying means so that opened flaps F of envelopes E are directed beneath an edge or lip 85 plate 80, allowing standard envelope insertion operations to be carried out in the region above plate while the envelopes E are held open. A conventional flap opening blade 90 may be used in connection with plate 80, to provide a tapered edge or shape which facilitates the placing of envelope flaps F beneath plate lip 85. Other retention means may also be used for holding envelope flaps F open after opening thereof by the jet means. For example, compressed air directed from above flaps F, or vacuum applied below flaps F, may be used to retain flaps in an open position.

As mentioned above, encoder means are preferably included with the invention for tracking or monitoring the position of envelopes on the conveyor means relative to the jet means. The encoder means preferably comprises shaft encoder 20 which is associated with a timing shaft (not shown) or other rotational member on inserter I. The timing shaft is mechanically interfaced with the drive shaft (also not shown) of inserter I, so that encoder 20 can track the machine cycle of inserter I by monitoring rotational angle information from the timing shaft. Encoder 20 is interfaced with computer 15, and provides rotational information regarding the timing shaft to computer 15. Since the timing shaft, like belt 60, is mechanically interfaced to the drive shaft, the rotational information provided by shaft encoder 20 to computer 15 indicates to computer 15 the location of envelopes E along belt 60. The encoder means of the invention may alternatively comprise an motor encoder associated with an electric or other type of motor which drives inserter I, with rotational angle information obtained directly from the motor. The encoder means may also comprise other standard sensing means for monitoring the position of envelopes E along belt 60.

The subject invention preferably includes sensor means for detecting whether or not flaps E have been correctly opened by the jet means. The sensor means, in the preferred embodiment, comprises a photocell 95 associated opening blade 90 and plate lip 85, and interfaced with computer 15 by conventional means (not shown). If, for any reason (such as a defective envelope), the air blast from the jet means of the invention fails to properly open an envelope flap F, the flap F will not be placed under blade 90 and plate lip 85, and photocell 95 will detect the absence of flap F thereunder. The presence of an improperly opened or unopened envelope flap is communicated to computer 15, which can then shut down the mail assembly process to avoid subsequent errors, such as mis-insertion mail materials or jamming of envelopes E due to an improperly positioned flap F. Other types of sensors and sensor arrangements and configurations may be employed as the sensor means of the present invention.

Figure 4:
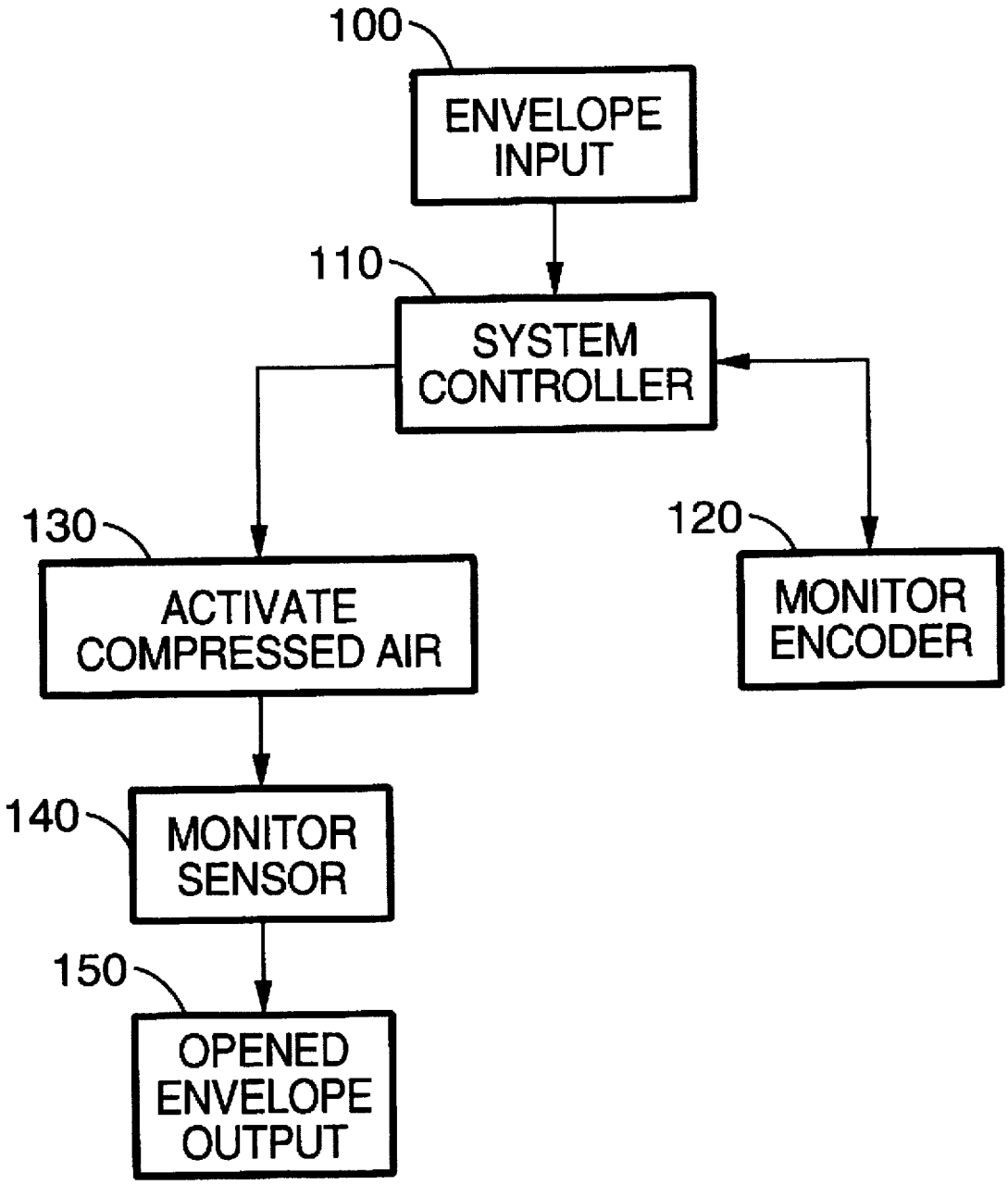
FIG. 4 is a flow diagram indicating a general control scheme for the subject envelope flap opener apparatus.

The operation of the subject invention will be more fully understood with reference to FIG. 4 as well as FIG. 1 through FIG. 3. Generally, envelope input 100 is carried out via sequential delivery of envelopes E from envelope stack 70, as described above, to belt 60 of the conveyor means of the invention. The sequentially provided envelopes from the envelope input 100 are received by claws 65 on belt 60, and directed towards the jet means of the invention. While, envelopes E are thus being provided to the jet means, other mail assembly operation, such as the printing and folding of mail materials for insertion, is generally being carried out simultaneously.

The overall mail assembly process, including the operation of envelope flap opener apparatus 10, is carried out under the direction of system controller 110 which, in the preferred embodiment, is computer 15 as aforementioned, and which is interfaced with shaft encoder 20 and sensor 95.

As the mail assembly operation is in progress, envelopes E are conveyed sequentially by belt 60 past nozzle 25 of the jet means. System controller 110 monitors encoder 120, which, as described above, is generally a shaft encoder 20 mounted on a timing shaft of the inserter I. Monitoring encoder 120 provides positional information regarding the machine cycle of the inserter, and thus the position of envelopes along belt 60, to system controller 110.

When monitoring the encoder 120 indicates to system controller 110 that an envelope is positioned adjacent the jet means, the system controller activates the compressed air 130 by actuating control valve 40, providing a blast or pulse of air towards the envelope flap and opening up the envelope flap. Before the envelope flap can close, belt 60 conveys the opened envelope to the retention means described above, whereby the opened flap is retained in an open position for insertion of mail materials thereinto. The delivery of the blast of compressed air is timed precisely to the arrival or positioning of an envelope E adjacent to nozzle 25. When envelope E has been conveyed past or out of range of nozzle 25 or after the envelope flap F has been opened, system controller 110 terminates the blast of compressed air to prevent unwanted drain on the compressed air supply used with the invention.

As described above, a photocell sensor 95 is associated with blade 90 is used to detect incorrectly opened or unopened envelope flaps due to defective envelopes or other causes. The system controller 110 monitors the sensor 140, and, if an unopened envelope flap is detected, the mail assembly operation may be interrupted to allow an operator to correct the error.

If no envelope opening error is detected by monitoring of sensor 140, the opened envelopes are outputted 150 for subsequent mail assembly operations, such as insertion, wetting, sealing, and postage metering.

Figure 5A:
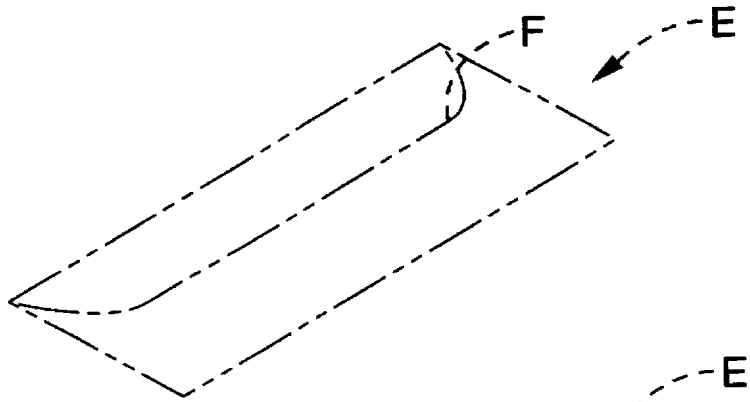
FIG. 5A–5D illustrate the manner in which a conventional envelope is opened by the subject invention.
Figure 5B:
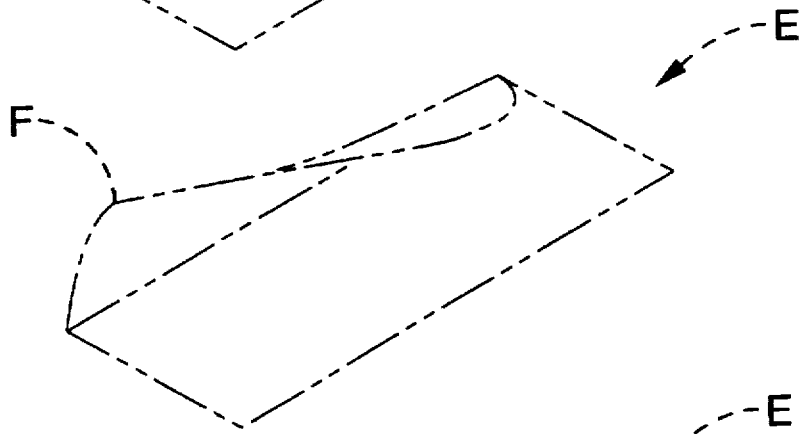
Figure 5C:
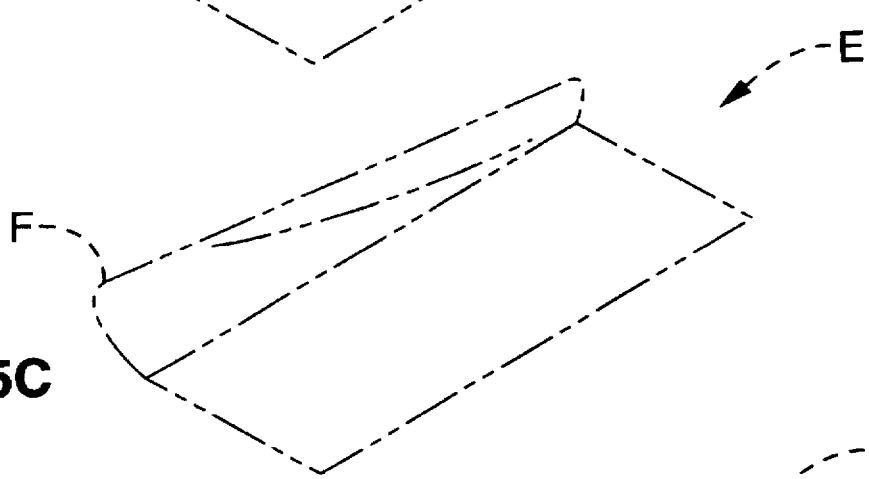
Figure 5D:
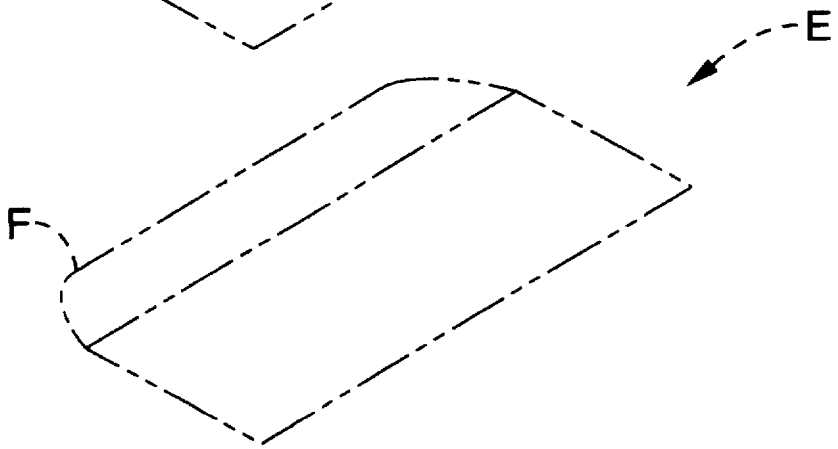

Referring now to FIG. 5A through FIG. 5D, there is shown the manner in which the subject invention opens a standard mailing envelope as the envelope is directed past the jet means by the conveyor means. In FIG. 5A, an unopened envelope E is shown with flap F folded over in a generally closed position, as supplied envelope manufacturers. FIG. 5B shows the flap F of envelope E in a partially opened position. The arrangement shown in FIG. 5B generally occurs when envelope E initially reaches the jet means of the invention and computer 15 activates control valve 40. In FIG. 5C, flap F is shown in a further opened position, as generally occurs when envelope E is adjacent to the jet means. After envelope E has been conveyed past the jet means of the invention, the flap F is fully opened as shown in FIG. 5D, at which point control valve 40 is turned off by computer 15, and the opened flap is directed to the retention means which holds flap F in the opened position, as described above, for insertion of mail materials into the envelope E.

Accordingly, it will be seen that the present invention provides an envelope flap opener apparatus which opens envelopes by timed blasts of compressed gas, which operates quickly and efficiently, and which is suitable for use with computer controlled mail assembly. Although the above description many specificities, these should not be construed as limiting the scope of the invention, but as merely providing illustrations of some of the presently preferred embodiments. Thus, the scope of the invention should be determined by the appended claims, and their legal equivalents.

What is claimed is:

1. A high volume envelope flap opener apparatus, comprising:

(a) jet means for directing an oriented burst of pressurized gas to open said envelope flap;

(b) conveyor means for sequentially moving a plurality of envelopes perpendicularly past said oriented burst of pressurized gas for said jet means (c) input means for sequentially supplying said plurality of envelopes to said conveyor means;

(d) control means for activating said jet means according to the position of said plurality of envelopes in said conveyor means;

(e) encoder means, interfaced with said control means, for monitoring the position of said envelopes in said conveyor means; and (f) error detection means for establishing if said envelope flap is open after said jet means operates on said envelope flap.

2. An envelope flap opener apparatus according to claim 1, further comprising retention means for holding said envelope flaps open after being opened by said jet means, said retention means positioned adjacent said conveyor means.

3. An envelope flap opener apparatus according to claim 1, further comprising sensor means, interfaced with said control means, for detecting said opened envelope flaps.

4. An envelope flap opener apparatus as recited in claim 1, wherein said jet means includes valve means for controlling gas supply, said control means interfaced with said valve means, said control means directing actuation of said valve means, wherein said valve means comprises:

(a) a solenoid valve, said solenoid valve interfaced with said control means; and (b) a hand actuated needle valve for accommodating different types of envelopes requiring greater or lesser amounts of gas to open said flap.

5. A high volume envelope flap opener apparatus, comprising:

(a) a position adjustable gas nozzle, said gas nozzle coupled to a gas supply line, said gas supply line including valve means for controlling gas supply;

(b) a conveyor track, said conveyor track positioned adjacent said gas nozzle, said conveyor track including a plurality of means for holding a plurality of envelopes, wherein said conveyor track transports said plurality of envelopes past said position adjustable gas nozzle in a direction perpendicular to gas exiting said position adjustable gas nozzle;

(c) input means for sequentially providing said plurality of envelopes to said holding means on said conveyor track;

(d) computer control means, interfaced with said valve means, for actuating said valve means according to the position of said plurality of envelopes on said conveyor track;

(e) error detection means for establishing, in cooperation with said computer control means, if said envelope flap is open after said jet means operates on said envelope flap; and (f) encoder means, interfaced with said control means, for tracking the position of said plurality of envelopes in said conveyor track, said encoder means mechanically interfaced with said conveyor track.

6. An envelope flap opener apparatus according to claim 5, further comprising plate means for holding said envelope flaps open, said plate means positioned adjacent said conveyor track.

7. An envelope flap opener apparatus as recited in claim 5, wherein said valve means comprises:

(a) a solenoid valve, said solenoid valve interfaced with said control means; and (b) a hand actuated needle valve for accommodating different types of envelopes requiring greater or lesser amounts of gas to open said flap.

8. A high volume envelope flap opener apparatus, comprising:

(a) a position adjustable gas nozzle, said gas nozzle coupled to a gas supply line, said gas supply line including valve means for controlling gas supply;

(b) a conveyor track, said conveyor track positioned adjacent said gas nozzle, said conveyor track including a plurality of means for holding a plurality of envelopes, wherein said conveyor track transports said plurality of envelopes past said position adjustable gas nozzle in a direction perpendicular to gas exiting said position adjustable gas nozzle;

(c) input means for sequentially providing said plurality of envelopes to said holding means on said conveyor track;

(d) plate means for holding said envelope flaps open, said plate means positioned adjacent said conveyor track said plate means including an opening blade;

(e) computer control means, interfaced with said valve means, for actuating said valve means according to the position of said plurality of envelopes on said conveyor track;

(f) error detection means for establishing, in cooperation with said computer control means, if said envelope flap is open after said jet means operates on said envelope flap, wherein said error detection means comprises a sensor associated with said plate means; and (g) encoder means, interfaced with said control means, for tracking the position of said envelopes in said conveyor track, said encoder means mechanically interfaced with said conveyor track.

9. An envelope flap opener apparatus as recited in claim 8, wherein said valve means comprises:

(a) a solenoid valve, said solenoid valve interfaced with said control means; and (b) a hand actuated needle valve for accommodating different types of envelopes requiring greater or lesser amounts of gas to open said flap.

* * * * *